US008096769B2

(12) United States Patent
Tibbott et al.

(10) Patent No.: US 8,096,769 B2
(45) Date of Patent: Jan. 17, 2012

(54) DAMPER

(75) Inventors: Ian Tibbott, Lichfield (GB); Caner H. Helvaci, Derby (GB)

(73) Assignee: Rolls-Royce PLC, London (GB)

( * ) Notice: Subject to any disclaimer, the term of this patent is extended or adjusted under 35 U.S.C. 154(b) by 393 days.

(21) Appl. No.: 12/382,535

(22) Filed: Mar. 18, 2009

(65) Prior Publication Data

US 2009/0263235 A1 Oct. 22, 2009

(30) Foreign Application Priority Data

Apr. 16, 2008 (GB) ..... 0806893.4

(51) Int. Cl.
*F01D 5/08* (2006.01)

(52) U.S. Cl. ..... 416/97 R; 416/96 R; 416/193 A; 416/220 R; 416/232; 416/500; 415/115; 415/116; 415/119

(58) Field of Classification Search ..... 415/115, 415/116, 119; 416/95, 96 R, 97 R, 190, 193 A, 416/220 R, 232, 500
See application file for complete search history.

(56) References Cited

U.S. PATENT DOCUMENTS 5,281,097 A * 1/1994 Wilson et al. ..... 416/193 A
5,388,962 A * 2/1995 Wygle et al. ..... 416/95
7,762,773 B2 * 7/2010 Liang ..... 416/97 R
7,811,058 B2 * 10/2010 Tibbott et al. ..... 416/97 R
2006/0110255 A1 5/2006 Itzel et al.
2007/0110580 A1 * 5/2007 Tibbott et al. ..... 416/193 A
2007/0134099 A1 * 6/2007 Lee et al. ..... 416/193 A
2010/0124508 A1 * 5/2010 Liang ..... 416/97 R

FOREIGN PATENT DOCUMENTS

EP 1 452 694 A3 9/2004
EP 1 790 824 A2 5/2007

* cited by examiner

*Primary Examiner* — Michael Lebentritt
(74) *Attorney, Agent, or Firm* — Oliff & Berridge PLC

(57) ABSTRACT

Dampers (56, 76, 96) are utilized with regard to mounting arrangements (50, 70, 90) in gas turbine engines (10) in order to facilitate cooling. It is known to provide slotted upper surface or cottage roof dampers to enhance cooling effect. However, cooling efficiency cannot be optimized and improving cooling effectiveness particularly between the parts of a mounting arrangement can be difficult without detrimental reductions in overall efficiency of a gas turbine engine (10) incorporating such a mounting. By provision of impingement jets (54, 75, 94) which extend through the damper (56, 76, 96) into slots (51, 71, 91) which define an upper surface of the damper (56, 76, 96) improvements in cooling efficiency can be achieved. The slots (51, 71 91) are typically closed to reduce requirements with respect to pressure differentials. However, open ended slots (51, 71, 91) with impingement jets (54, 74, 94) can also be provided. Typically, the slots (51, 71, 91) extend laterally across the dampers (56, 76, 96) but could also extend longitudinally with closed ends or one end open. By such an approach improved heat transfer is achieved without necessary increases in pressure gradients and flow rates.

17 Claims, 4 Drawing Sheets

DAMPER

The present invention relates to dampers and more particularly to dampers utilised in platform arrangements of gas turbine engines in order to facilitate cooling.

Referring to FIG. 1, a gas turbine engine is generally indicated at 10 and comprises, in axial flow series, an air intake 11, a propulsive fan 12, an intermediate pressure compressor 13, a high pressure compressor 14, a combustor 15, a turbine arrangement comprising a high pressure turbine 16, an intermediate pressure turbine 17 and a low pressure turbine 18, and an exhaust nozzle 19.

The gas turbine engine 10 operates in a conventional manner so that air entering the intake 11 is accelerated by the fan 12 which produces two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustor 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbines 16, 17 and 18 respectively drive the high and intermediate pressure compressors 14 and 13 and the fan 12 by suitable interconnecting shafts 26, 28, 30.

In view of the above it will be appreciated that the performance of a gas turbine engine, whether measured in terms of efficiency or specific output, is improved by increasing turbine gas temperature. It is desirable to operate the turbine at as high a temperature as possible as increasing the turbine entry temperature will always produce more specific thrust. Unfortunately, as turbine entry temperatures increase it will be understood that the operational life of an uncooled turbine blade assembly falls so necessitating either development of better materials or introduction of internal air cooling.

Internal convection and external cooling films are primary methods of cooling but it will be appreciated that the proportion of cooling air consumed will tend to be skewed towards the high pressure turbine stages of an engine. Generally the cooling air is taken from the compressor stages and therefore it will be appreciated that extracted coolant air has an adverse effect upon engine operational efficiency. In such circumstances both the volume of coolant air taken and the efficiency of its use are highly important with regard to overall engine acceptability.

Particular problems relate to cooling high pressure turbine blade platform structures. Previously embedded convective holes have been drilled into these platform structures of a gas turbine engine. However, such convective holes are problematic in terms of providing stress concentration. It will be understood that hot gas washes over the surfaces which are then highly stressed both mechanically due to centrifugal loading and thermally due to the temperature gradients created. In such circumstances although providing cooling holes is successful in reducing metal temperatures and associated thermal gradients these holes significantly increase three dimensional stress levels and so can be counterproductive.

Another arrangement to improve cooling is to provide a so-called slotted cottage roof damper. In such arrangements there is controlled leakage of coolant through a series of staggered slots machined or cast into an upper contact surface of a damper. The coolant, typically air, as shown in FIG. 2 additionally cools a disc post 30 and then is taken from a cavity 31 to pass through slots 32 in an upper surface of the damper 33. The upper surface of the damper 33 engages with an opposed reciprocal surface in a platform 34 to create channels within which a coolant flow 35 passes. Thus, the coolant flow cools the surfaces of the damper 33 and the platform 34 edges before emerging through a gap in the form of spent coolant 36. The coolant flow 35 is generally bled from a main coolant flow 37 and the spent coolant flow 36 mixes with secondary coolant flows 38 within the structure to create entrained and turbulently mixed flows 39. Such mixing with the secondary flows can be problematic such that a refinement is to angle the gap in the platform 34 in order to create improved film cooling "attachment" to wall portions of a cavity 40 within which the entrained flow 39 is mixed.

Although slotted cottage or upper surface arrangements provide improvements it will be understood that the levels of heat transfer are still relatively low as there is very little or no spatial room to incorporate heat transfer augmentation devices and structures such as trip strips, pedestals or pin fins. It will also be understood that accurate machining is difficult leading to tolerance variability with regard to the slots formed in the damper 33. Such variability requires relatively high levels of coolant pressure to be maintained to ensure there is no hot gas ingestion. Furthermore, it will be appreciated that flow distribution of the coolant within the slots formed in the platforms 33 is largely dictated by pressure differentials at the edges of the platform 34 where neighbouring platforms meet. Local static pressure at a front or upstream end of the platform is always at a higher level than at a rear or downstream end of the platform. Consequently the volume of coolant passing through the slots located downstream exceeds that passing through slots located upstream. Normally such a flow distribution is acceptable as it is in general agreement with heat load distribution: higher heat loads exist at the downstream end of the platforms. However, as gas temperatures increase it will be understood that there is an increasing need to provide further cooling at upstream locations but such improvements in upstream cooling are difficult due to necessary improvements required in flow levels and distribution. These necessary changes will result in greater leakage and so reduced overall efficiency.

In accordance with aspects of the present invention there is provided a damper for a gas turbine engine, the damper having slots in an upper surface of the damper to provide coolant flow paths, the slots associated with impingements jets extending from below the upper surface laterally into the slots.

Possibly, at least some of the slots are closed towards a lower edge of the upper surface.

Generally, the impingement jets extend from a base surface of the damper.

Typically, the slots vary in width and/or length and/or depth and/or angle. For example, the slots may vary in width and/or depth along the length of a respective slot. Further for example, the slots may vary in terms of width and/or length and/or depth between slots in the upper surface.

Possibly, the impingement jets vary in length and/or width and/or depth and/or angle. For example, the impingement jets may vary in width and/or depth along the length of the respective jet. Additionally for example, the impingement jets may vary in width and/or depth between respective impingement jets to a respective slot and/or different slots in the upper surface. Possibly, the impingement jets are round or elliptical in cross section.

Possibly, the slots are evenly distributed upon the upper surface.

Possibly, the impingement jets are evenly distributed along a respective slot and/or within the upper surface.

Generally, the impingement jets are associated with a respective slot at an impingement angle to achieve a desired impingement area opposite the slot.

Generally, the upper surface has a roof configuration with an apex at an upper joining edge of two parts of the upper surface.

Also in accordance with aspects of the present invention there is provided a mounting arrangement for use in a gas turbine engine including a damper as described above engaging a reciprocal surface of a platform to define a channel between the reciprocal surface and the slots. Generally a cavity is provided below the damper for a coolant flow.

Generally, the slots respectively diverge towards the upper surface from the cavity.

Also in accordance with aspects of the present invention there is provided a gas turbine engine incorporating a damper and/or a mounting arrangement as described above.

Embodiments of aspects of the present invention will now be described by way of example only with reference to the accompanying drawings in which.

Figure 1:
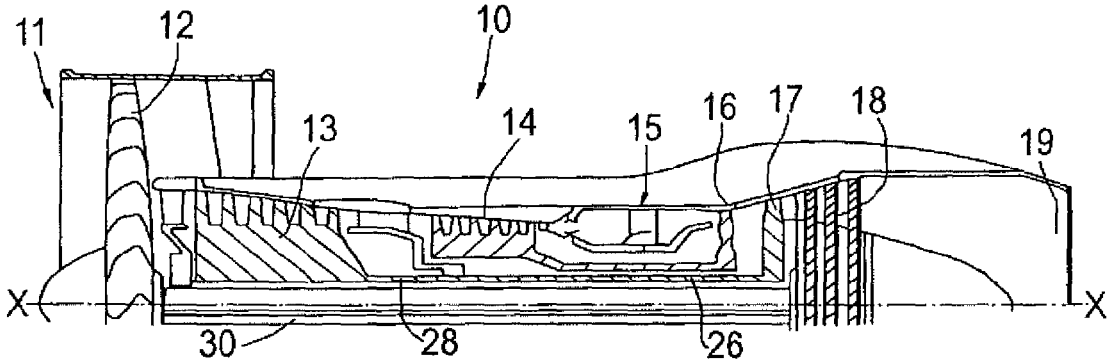
Fig.1 RELATED ART
Figure 2:
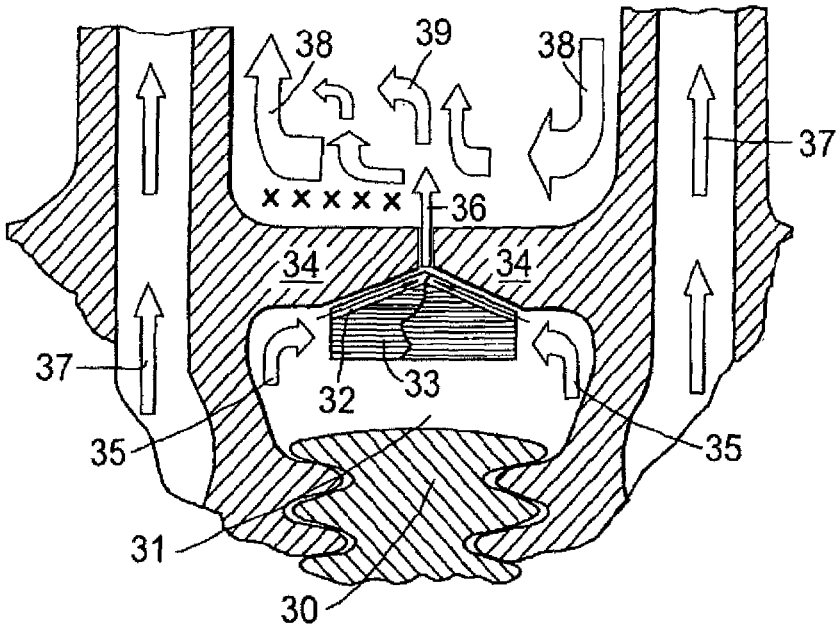
Fig.2 RELATED ART

As indicated above simple adaptation of an existing slotted or cottage roof type damper would generally not be satisfactory. If the slots are increased in size in terms of depth then the flow control becomes a function of the gap as the gap is not dimensionally stable due to build up of manufacturing tolerances. Furthermore it will be appreciated at typical cruise conditions the gap between platforms will become larger than at take off such that large quantities of coolant will effectively be wasted during a cruise condition when the degree of cooling is most critical. It will be understood that cooling in terms of the amount of coolant needed is generally reduced at such cruising conditions.

In view of the above it is desirable to produce an increased heat transfer level with better control of coolant flows and in all conditions. Furthermore it would be advantageous to be able to control heat transfer distributions without having to increase feed pressure levels which as indicated above would result in greater leakage and therefore losses significantly altering efficiency. It will also be understood that improved levels of platform film cooling would be advantageous.

Aspects of the present invention are arranged to provide improvements on a like for like basis in terms of heat transfer levels using the same volume of coolant. In a first embodiment depicted with regard to FIG. 3 and FIG. 4 previous relatively narrow and shallow slots are replaced with wider and deeper slots 51. In the embodiment depicted the slots 51 are closed at an upstream end 52 where they are in fluid communication with the cavity 53 within which a coolant flow is presented. In such circumstances fluid flow for coolant presentation is achieved through a series or array of holes which define impingement jets 54. The jets 54 extend effectively laterally into association with the slots 51 with an impingement angle which may approach perpendicular. Such lateral association ensures that the coolant flow projected from the jets 54 impinges upon an opposed platform surface to be cooled. The coolant flow passes through these impingement jets 54 to impinge upon a reciprocal opposed impingement surface of a platform 55. In such circumstances the slots 51 are formed in an upper surface of a damper 56 with the impingement jets 54 arranged to cool the platform 55 with coolant flow before exiting through a gap 57 between neighbouring platforms 55*a*, 55*b*. In such circumstances the film cooling protection 58 is still presented within a cavity 59 by projection of a spent flow 60 such that this flow 60 lingers against a platform surface 61 as indicated to create a film cooling effect. The coolant in the film cooling projection eventually mixes with coolant 65 within the cavity 59.

It can be shown that impingement coolant flows are generally more effective than simple channel flows as provided by previous slotted or cottage roof dampers utilised in mounting arrangements. Thus, the mounting arrangement 50 will generally have increased levels of heat transfer provided adequate pressure ratios can be defined across the impingement jets 54. These pressure ratios it will be appreciated are dependent upon the coolant 66 pressure within the cavity 53. However, the mounting arrangement 50 will generally be located upon a rotary component such as a turbine disc 64 such that in addition to static pressure there will also be a dynamic pressure generated by the centrifugal forces of rotation. In such circumstances there should be generally an adequate pressure ratio across the impingement jets provided they are appropriately configured and orientated.

It will be appreciated that the holes which define the impingement jets can be drilled with significantly better manufacturing tolerances than previously with regard to slots and in such circumstances more accurate control of coolant flows through the jets 54 can be achieved. As flow control is maintained at the impingement jets 54 it will be appreciated that slot 51 dimensions in terms of width and depth as well as platform to platform gap 57 can be configured such that they have little or no part in flow control provided they have a significantly greater flow cross sectional area than the combined area of the impingement jets 54. In such circumstances the manufacturing and assembly tolerances of the slots 51 and the gap 57 are of reduced importance.

Figure 3:
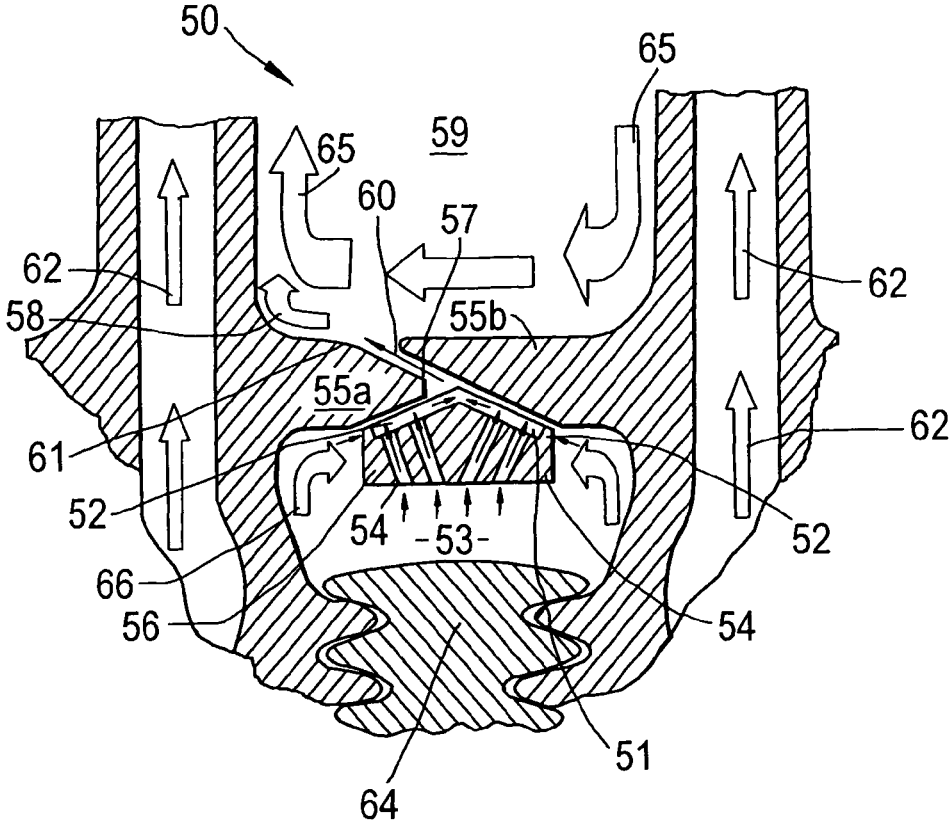
FIG. 3 is a schematic illustration of a mounting arrangement in accordance with a first embodiment of aspects of the present invention.
Figure 4:
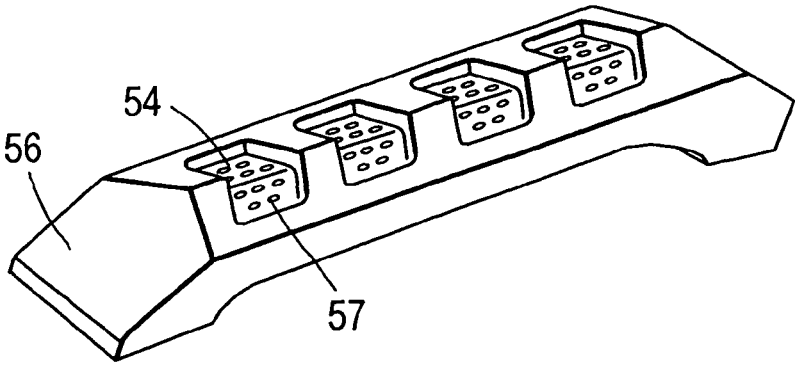
FIG. 4 is a perspective schematic view of the damper utilised in the first embodiment of aspects of the present invention as depicted in FIG. 3.

As indicated above FIG. 3 and FIG. 4 provide respective schematic illustrations of a first embodiment of aspects of the present invention. Thus, as can be seen each channel defines effectively blocked or blind slots to create impingement cavities which are machined in an upper surface of the damper 56. These upper surfaces will mate and be reciprocal with opposed surfaces of the platforms 55 (FIG. 3). In such circumstances as indicated above the improved heat transfer benefits of coolant jet impingement are on opposed surfaces of the platforms 55 as well as reduced coolant leakage will be beneficial.

Figure 5:
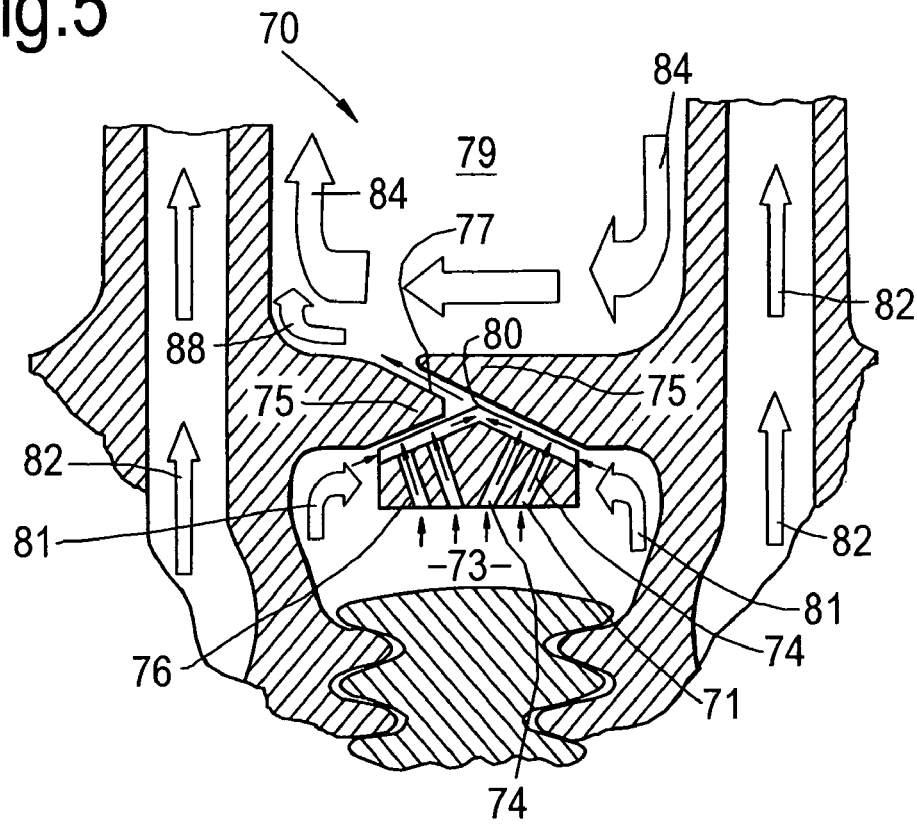
FIG. 5 is a schematic cross section of a mounting arrangement in accordance with a second embodiment of aspects of the present invention.
Figure 6:
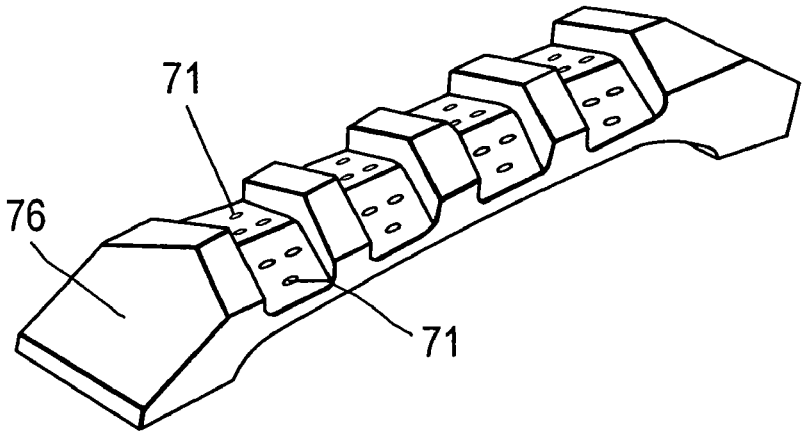
FIG. 6 is a schematic perspective view of the damper depicted in FIG. 5.

FIG. 5 and FIG. 6 illustrate a second embodiment of a mounting arrangement 70 in accordance with aspects of the present invention. The arrangement 70 incorporates a damper 76 which features both open slots 71 and impingement jets 74 presenting coolant flow into the slots 71. The slots 71 have smaller open areas at their upstream locations and lower flow areas as their downstream locations. This is achieved as depicted in FIG. 6 by varying the depth of the slots 71. Generally, the impingement jets 74 are drilled through the body of the damper 76 in order to exit into the slot 71. In such circumstances coolant flow is fed from the open upstream end that is in fluid communication with the under platform pocket cavity 80. The impingement jets 74 in such circumstances present coolant flows which impinge when ejected upon an underside of the platforms 75 whilst coolant flow 81 will pass about the impingement jets such that the impingement jets in terms of projected coolant flow will act as fluid "pedestals" resulting in turbulence and heat transfer by the coolant impingement jets 74 upon the surfaces of the platform 75. In such circumstances the cross flow 81 from a cavity 73 will also act as a cross flow to the impingement jets causing smearing of those impingement jets and extending the characteristic shape of such impingement with the platform 75 from a generally circular to an elliptical footprint. Such an arrangement may enhance heat transfer and cooling of the platforms 75.

In other respects the second embodiment depicted in FIG. 5 and FIG. 6 is similar to the previous embodiment depicted in FIGS. 3 and 4. In such circumstances a principal coolant flow 82 is still provided and from which the coolant within the cavity 73 is taken. Spent coolant projected from the damper 76 passes through a gap 77 into a cavity 79 where it mixes with secondary flows 84 and in view of the angle of the gap 77 creates film cooling 88.

In the above circumstances it may be considered that the second embodiment depicted in FIG. 5 and FIG. 6 is a hybrid comprising a previous open slotted and cottage type upper surface with coolant paths and impingement jets 74 in accordance with aspects of the present invention. These impingement jets 74 as indicated are machined into an upper surface and extend from below in the damper 76. It will be appreciated that the impingement jets 74 generally extend from a base surface of the damper 76 but in some circumstances may extend from side surfaces dependent upon the angle of projection and impingement required against opposed surfaces of the platform 75.

It will be understood that the upper surface of dampers in accordance with aspects of the present invention as indicated take a gabled roof cross section. In such circumstances the upper surfaces of the dampers generally comprise two parts extending from a lower edge to an upper joining edge. The slots in accordance with aspects of the present invention will be located between this upper edge and respective lower side edges. The extent, depth, angle and width of the slots may be adjusted dependent upon requirements. In such circumstances in order to control coolant flow the depth width and length of the respective slots can be adjusted to provide the most efficient presentation of coolant flow at impingements upon the platforms.

The impingement jets similarly can be adjusted in terms of their length, width, angle and depth in order to provide differing coolant flow restrictions and therefore presentation of impingement jets to the platforms for cooling effect.

Generally, the slots and/or the impingement jets in accordance with aspects of the present invention will be evenly distributed within the damper. However, again in order to provide localised variation between particularly upstream and downstream positions different configuration of slots and impingement jet density can be provided to maximise coolant flow and impingement where required for heat transfer and cooling effect.

It will be noted that the impingement jets in accordance with aspects of the present invention are generally angled as they extend from a lower surface of the damper to the slots. The angle into lateral association may be as indicated substantially perpendicular to the slots or as required to define an impingement "footprint". It will be appreciated that if the impingement jets are not perpendicular then generally the impingement coolant flow from the impingement jets will engage the opposed surface with an elliptical engagement footprint. Such an elliptical engagement footprint may provide less focussed heat transfer and therefore a reduced cooling effect. It will also be understood that the length of the impingement jets within the dampers will also alter the cooling effect of the coolant flow within the damper itself and therefore potentially the temperature of the coolant flow presented externally from the impingement jets upon the platform.

Generally aspects of the present invention allow for impingement cooling without the necessity for changing platform mounting geometry as the impingement cavities themselves are created within the upper surface of the damper by the slots and these impingement cavities are fed with coolant flow through the impingement jets. In such circumstances dampers can be provided within mounting arrangements in accordance with aspects of the present invention as a retro fit by simply replacing existing slotted roof or cottage roof dampers as required.

By increasing levels of heat transfer without increasing flow rates it will be understood that greater cooling efficiency without increasing coolant leakage losses and therefore reductions in efficiency with regard to the engine overall are achieved. Similarly, increased levels of heat transfer are achieved without increasing flow pressure and the pressure ratio across the damper which itself may cause leakage losses. Increased heat transfer is achieved through larger wetted surface areas exposed to the coolant but not by altering the coolant flow levels themselves. Provision of the impingement jets actively cools the dampers and so may allow lower grade materials to be utilised to form these dampers.

As aspects of the present invention allow provision of tighter manufacturing tolerances with respect to circular hole drilling for the impingement jets as opposed to those associated with forming slots, coolant flow can be better controlled and predicted and hence there will be less coolant wastage during all stages of operation and particularly at cruise conditions where the gaps between platforms may significantly increase.

By aspects of the present invention a gas turbine engine can be provided which has improved turbine stage efficiency and fuel consumption as a result of reduced coolant flow and leakage. Alternatively, increased turbine gas temperatures are possible as a consequence of improved cooling performance and therefore greater engine performance in use for the same coolant flow rates.

Overall aspects of the present invention allow configuration of mounting arrangements and dampers which give better heat transfer distribution control compared with slots only. Furthermore, the spent impingement coolant which escapes in the gaps between neighbouring platforms will generally be provided such that it does not compromise film cooling protection particularly on a suction side of such platform conjunctions.

Aspects of the present invention are particularly applicable to cottage or slotted roof shaped dampers but it will also be understood that locked or open slots with impingement jets may be machined into dampers which do not take a gabled or sloped roof configuration. In such circumstances dampers which have curved or flatter configurations may also incorporate combinations of slots and impingement jets in accordance with aspects of the present invention. It will be understood that the slots along with the impingement jets will be machined into the dampers specifically to provide coolant efficiency. Generally the dampers may be arranged to have single contact only with one side of a platform conjunction or with both sides in order to create channels within which coolant flow can pass and be confined.

It is possible to provide a combination of slotted and slotted plus impingement jets, themselves either open or closed within the same damper in order to create localised cooling differentials for more efficient cooling operation.

Figure 7:
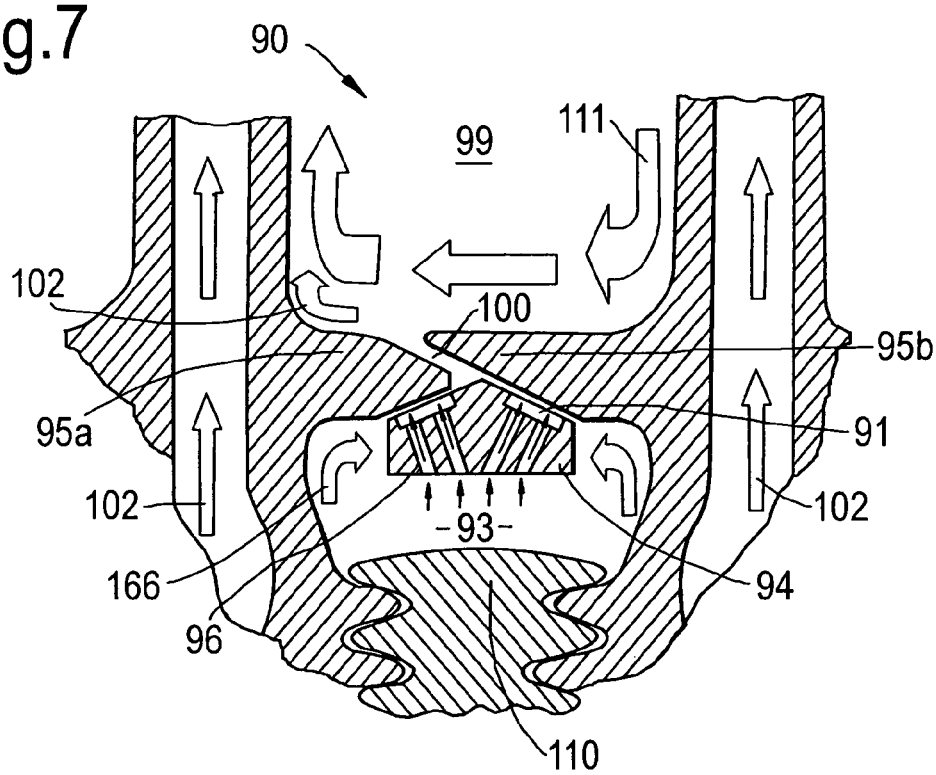
FIG. 7 is a schematic side cross section of a mounting arrangement in accordance with a third embodiment of aspects of the present invention.
Figure 8:
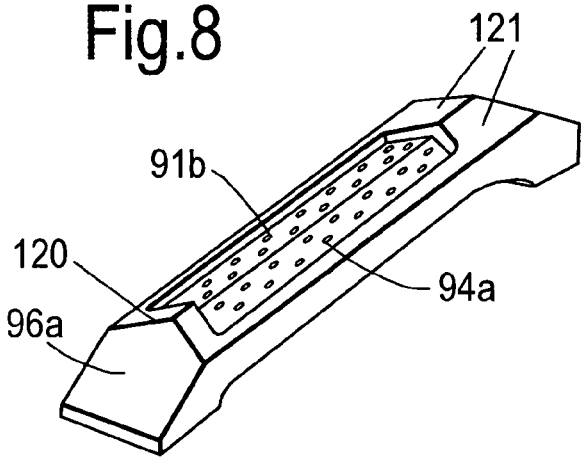
FIG. 8 is a schematic perspective view of a first alternative damper utilised in accordance with the embodiment of the mounting arrangement depicted in FIG. 7.
Figure 9:
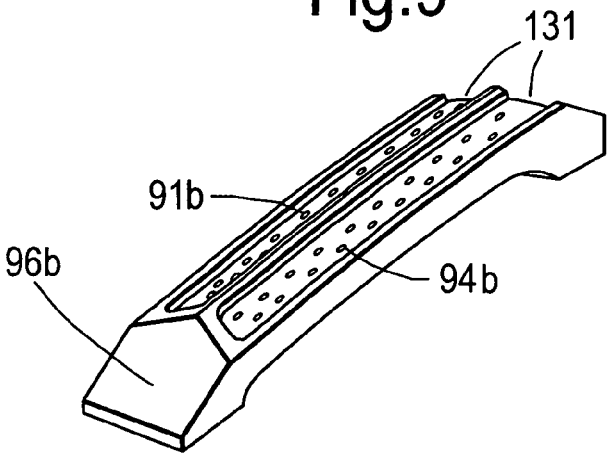
FIG. 9 is a schematic perspective view of an alternative damper utilised in the embodiment of a mounting arrangement depicted in FIG. 7.

It will be noted that the first and second embodiments of aspects of the present invention depicted in FIGS. 3 to 6 have slots which extend across the respective dampers. However, an alternative would be to provide as illustrated in FIGS. 7 to 9 slots or recesses which extend continuously along the length of the damper. These slots or recesses will be aligned with an edge of the damper and are therefore generally parallel with abutting edges of the respective platforms. In such circumstances a mounting arrangement 90 again provides a damper 96 which is located within a cavity 93 formed by platforms 95. Platform 95*a* constitutes a suction surface whilst platform 95*b* presents a pressure surface. In such circumstances coolant flow 106 again passes through impingement jets 94 to slots 91 for impingement with the respective platforms 95. Spent coolant then passes through a gap 100 to create a coolant film 102 within a cavity 99. As previously coolant flows 102 are tapped in order to provide the coolant within the cavity 93. The cavity 93 as indicated above is formed between the platforms 95 and typically a rotor disc 110 to locate an aerofoil including the mounting arrangement 40 in accordance with aspects of the present invention. The main flow as previously cools the aerofoil and presents secondary flows 111 with the cavity 99 which combines with the spent coolant flows passing through the damper 96 for eventual release.

In accordance with a third embodiment of aspects of the present invention depicted in FIGS. 7 to 9 as indicated generally the slots are continuous along the length of the damper 96. In such circumstances it is possible to provide slots which are open or blocked at one or both ends. FIG. 8 illustrates a slot which is closed at both ends 120, 121. In such circumstances impingement coolant flows through the impingement jets 94*a* are better confined. The arrangement and configuration in terms of widths, angles and lengths of the respective impingement jets 94*a* as well as the length, width and depth of the slot 91*a* can be adjusted dependent upon cooling requirements in relation to the platforms 95 (FIG. 7) and requirements within an engine.

An alternative to the closed ended slot 91*a* depicted in FIG. 8 is to provide a continuous slot 91*b* which is open at one end 131. In such circumstances again impingement jets 94*b* are provided in order to create impingement cooling within an opposed platform 95 (FIG. 7). However, in such circumstances there will be slot flow from the open end 131. In any event, by having a continuous slot 94*a*, 94*b* it will be understood that flow can be provided from a front to a rear of a platform association within which the coolant can flow before exhausting into the gap between neighbouring platforms. Thus, the slots 94*a* are continuous and longitudinal with the impingement jets distributed and configured as required for particular heat transfer performance within a mounting arrangement and therefore a gas turbine engine.

As indicated above slots in accordance with aspects of the present invention may vary in terms of depth as well as width dependent upon requirements. Similarly, the impingement jets may be of varying diameter as well as length within the same slot or between different slots in a mounting arrangement.

Although more convenient to manufacture and fabricate drilled holes could be replaced with slots or elongated holes formed in juxtaposed elements sandwiched together to form dampers in accordance with aspects of the present invention. Drilled holes will generally be circular but by such creation of impingement slots or elongated holes alternative impingement jet configurations and orientations may be achieved including creation of kinks and bends in the impingement jet path from a lower part of the damper 2 association with the slots in accordance with aspects of the present invention.

Generally, the impingement jets are angled within a damper in order to lengthen the impingement height to diameter and so create greater entrainment and a larger contact area with the platform for cooling effect.

It will also be understood that heat transfer augmenting structures such as trip strips, pedestals, pin fins and cooling fins could be incorporated within the slots in accordance with aspects of the present invention in order to improve heat transfer in addition to provision of impingement through the impingement jets for cooling and greater cooling efficiency.

As indicated above aspects of the present invention are particularly applicable for use with respect to gas turbine engines and those engines used in civil, military, marine and industrial applications. Nevertheless, aspects of the present invention can also be incorporated within mounting platform arrangements that employ a damping device and which require cooling in use. Although beneficial with respect to rotary devices where the dynamic pressure created by such rotation can be used in order to drive coolant flow through the impingement jets it will also be understood that dampers as well as mounting arrangements in accordance with aspects of the present invention could also be included in more static nozzle guide vane platforms and air seal segments.

Modifications and alterations to aspects of the present invention will be appreciated by those skilled in the art. Thus for example as indicated above generally impingement jets will extend in substantially a straight line across a damper in order to create an impingement flow which engages with an opposed surface of a platform. Alternatively, impingement jets may be curved and arranged to taper from one end to the other in order to alter the impingement flow and therefore performance of the heat transfer function and effectiveness in use. Generally the impingement jets will be a single passage or hole through the damper but alternatively impingement jets could split to create more than one impingement coolant flow for projection towards a platform surface. Such splitting of coolant flow may also enhance cooling effects within the damper itself.

We claim:

1. A damper for a gas turbine engine, the damper having slots in an upper surface of the damper to provide coolant flow paths, the slots associated with impingements jets extending from below the upper surface laterally into the slots.

2. A damper as claimed in claim 1 wherein at least some of the slots are closed towards a lower edge of the upper surface.

3. A damper as claimed in claim 1 wherein the impingement jets extend from a base surface of the damper.

4. A damper as claimed in claim 1 wherein the slots vary in at least one of width, length, depth and angle.

5. A damper as claimed in claim 4 wherein the slots vary in at least one of width and depth along the length of a respective slot.

6. A damper as claimed in claim 4 wherein the slots vary in terms of at least one of width and depth between slots in the upper surface.

7. A damper as claimed in claim 1 wherein the impingement jets vary in at least one of length, width, depth and angle.

8. A damper as claimed in claim 7 wherein the impingement jets vary in at least one of width and depth along the length of the respective jet.

9. A damper as claimed in claim 7 wherein the impingement jets vary in at least one of width and depth between respective impingement jets to at least one of a respective slot and different slots in the upper surface.

10. A damper as claimed in claim 1 wherein the impingement jets are one of round and elliptical in cross section.

11. A damper as claimed in claim 1 wherein the slots are evenly distributed upon the upper surface.

12. A damper as claimed in claim 1 wherein the impingement jets are evenly distributed along at least one of a respective slot and within the upper surface.

13. A damper as claimed in claim 1 wherein the impingement jets are associated with a respective slot at an impingement angle to achieve a desired impingement area opposite the slot.

14. A damper as claimed in claim 1 wherein the upper surface has a roof configuration with an apex at an upper joining edge of two parts of the upper surface.

15. A mounting arrangement for use in a gas turbine engine including a damper as claimed in claim 1 engaging a reciprocal surface of a platform to define a channel between the reciprocal surface and the slots.

16. An arrangement as claimed in claim 15 wherein a cavity is provided below the damper for a coolant flow.

17. An arrangement as claimed in claim 15 wherein the slots respectively diverge towards the upper surface from the cavity.

* * * * *